US005787962A

United States Patent [19]

Perrella et al.

[11] Patent Number: 5,787,962

[45] Date of Patent: Aug. 4, 1998

[54] COLD CHAMBER DIE CASTING CASTING MACHINE AND METHOD

[75] Inventors: Guido Perrella, Westmount; Nicolas Bigler, Morin Heights, both of Canada

[73] Assignee: DBM Industries Ltd., Quebec, Canada

[21] Appl. No.: 963,991

[22] Filed: Nov. 4, 1997

Related U.S. Application Data

[63] Continuation of Ser. No. 712,579, Sep. 13, 1996, abandoned, which is a continuation of Ser. No. 436,200, filed as PCT/CA93/00485, Nov. 17, 1993, published as WO94/11136, May 26, 1994, abandoned.

[30] Foreign Application Priority Data

Nov. 17, 1992 [CA] Canada ..... 2083082

[51] Int. Cl.[6] ..... B22D 17/08

[52] U.S. Cl. ..... 164/113; 164/312

[58] Field of Search ..... 164/113, 312

[56] References Cited

U.S. PATENT DOCUMENTS

| | | | |
|---|---|---|---|
| 3,208,113 | 9/1965 | Bennett | 164/312 |
| 3,672,440 | 6/1972 | Miura et al. | 164/113 X |
| 4,178,983 | 12/1979 | Mochizuki et al. | 164/113 |

FOREIGN PATENT DOCUMENTS

| | | | |
|---|---|---|---|
| 0036687 | 9/1981 | European Pat. Off. | 164/312 |
| 57-14456 | 1/1982 | Japan | 164/113 |
| 58-148066 | 9/1983 | Japan | 164/312 |
| 64-34555 | 2/1989 | Japan | 164/312 |
| 2123326 | 2/1984 | United Kingdom . | |

*Primary Examiner*—J. Reed Batten, Jr.
*Attorney, Agent, or Firm*—McCormick, Paulding & Huber

[57] ABSTRACT

A top filling injection unit for a cold chamber die casting machine, the cold chamber die casting machine having a fixed platen, a moving platen, a fixed die half and a moving die half, the fixed die half is mounted on the fixed platen and the moving die half is mounted on the moving platen, a part line on which the moving die half and fixed die half meet, the top filling injection unit comprised of an open upwardly inclined injection sleeve, an injection plunger, an injection plunger piston, an injection cylinder and an injection piston, an aperture in the fixed die half defining an opening, the injection sleeve is secured in the opening in the fixed die half, with the top of the injection sleeve proximate the part line, the injection plunger having a retractable filling position and an upper injection position, the injection plunger is lowered to a selected filling position, the upper injection position of the injection plunger being proximate the part line.

8 Claims, 4 Drawing Sheets

COLD CHAMBER DIE CASTING CASTING MACHINE AND METHOD

This is a continuation of application Ser. No. 08/712,579 filed on Sep. 13, 1996 which is a continuation of application Ser. No. 08/436,200, filed as PCT/CA93/00485, Nov. 17, 1993 published as WO94/11136, May 26, 1994 both now abandoned.

This invention relates to an injection system for injecting metal into a die in a cold chamber die casting process.

The injection system includes an upwardly disposed injection sleeve having an open top which is adapted to be top filled with molten metal. The volume of the injection sleeve is varied by adjusting the lower position of the plunger in the injection sleeve. The injection system is used with a die casting machine having a fixed die half attached to a fixed platen. The top of the injection sleeve is proximate or on the part line at which the die halves close. The plunger in the injection sleeve is adapted to force the hot metal into the die cavity after the die halves are locked.

An injection sleeve receiver adapted to receive the injection sleeve is connected to the fixed platen immediately below the fixed die half which is also connected to the fixed platen. The injection sleeve may be withdrawn from the injection sleeve receiver for servicing and returned to the injection sleeve receiver where it remains during casting operations.

In another embodiment of the invention an aperture defining an opening in the fixed die half is substituted for an injection sleeve receiver.

In preparation for top filling the injection sleeve with molten metal, the die halves are opened, the top of the injection sleeve extends into an injection sleeve receiver which is fastened to the fixed platen below the fixed die half so as to present an open cylinder adapted to receive hot metal by ladle or other means. The volume of the injection sleeve is controlled by controlling the position of the injection plunger in the injection sleeve. The position of the injection plunger is controlled so that the size of the metal shot required for a particular casting will substantially top up the injection sleeve when the injection sleeve is filled with molten metal.

The extent of retraction of the injection plunger is adjusted relative to the volume of molten metal required to complete the metal casting. For a large metal casting requiring considerable metal the injection plunger is retracted deeply into the injection sleeve whereas for a smaller casting requiring less metal the plunger is retracted less deeply into the injection sleeve. It is desirable that the injection sleeve be top filled by ladling or other means approximately to the top of the injection sleeve to minimize air inclusion during the casting operation.

After the injection sleeve is filled with metal the moving platen and moving die half are closed on the part line, clamping pressure is applied to the moving platen and dies, the injection plunger is advanced driving the molten metal through a runner in the face of the moving die half into the cavity between the die halves. When the casting is sufficiently solid, the injection plunger is retracted, the clamping pressure is released and the moving platen and die half are opened. The casting and biscuit are simultaneously removed with the opening of the moving die half. When the die halves are open molten metal may be ladled or otherwise transferred into the injection sleeve prior to the next cycle.

The injection system of this invention avoids any ninety degree turns between the injection sleeve and the die halves in which the casting is effected. The forcing of molten metal into the die halves through a combination of turns may result in pressure drops causing the metal to cool or in the alternative introducing the molten metal at a higher temperature to allow for temperature loss. The instant injection system without any ninety degree turns between the injection sleeve and the runner or die halves is consistent with maintaining a suitable time cycle per shot.

One problem in some existing die casting machines is caused by air entrapment associated with ninety degree turns between the injection sleeve and the die halves in which casting is effected. Air entrapment is caused by wave fronts created as the metal approaches and travels around a ninety degree turn into the runners and cavity. Transferring molten metal around ninety degree turns also causes unwanted load losses and turbulence.

Some metals such as liquid aluminum used in cold chamber die casting are very corrosive. In prior die casting machines for casting aluminum the aluminum travelled a substantial distance before reaching the cavities in the mold. Being highly corrosive the longer the distance the liquid aluminum has to travel the greater the wear on the delivery system. In this invention the injection sleeve when in operative position is immediately adjacent the part line. The aluminum or other corrosive metal has a very short distance to travel during injection.

In the processes of filling the injection sleeve the liquid metal is ladled, poured or otherwise transferred directly into the top of the injection sleeve which is open when the die halves of the die casting machine are opened. The opening at the top of the injection sleeve is closed by the closing of the moving platen and moving die half. The injection unit is disposed either below the die halves or at an angle up to 15° below the horizontal centerline through the die halves. The instant invention has the advantage of easy top ladling or transfer by robot of molten metal into the top opening of the injection sleeve. Metal filling of the injection sleeve dose to the top of the injection sleeve results in less entrapped air in the injection sleeve when the top of the injection sleeve is closed by the moving die half.

The avoidance of any ninety degree angles between the sleeve of the injection unit and the cavity of the die halves results in less entrapped air.

The injection unit of the instant invention includes an injection plunger which displaces the molten metal from the injection sleeve through a short runner directly into the cavity. The die filling is less affected by gravity than most existing machines. The injection system for a die casting machine disclosed herein has a metal to air ratio of 80 to 90% compared with 30% for some conventional machines.

The injection unit of the instant invention includes a temperature control system associated with the injection plunger such that the temperature of the injection plunger may be controlled to improve the speed of each cycle and thus the speed of the machine. In the machine of this invention removal of the casting and filing of the injection sleeve can be carried out simultaneously once the die halves have opened.

U.S. Pat. No. 5,379,827 to Perrella et al. entitled Die Casting Machine disclosed an improved die casting machine which has a frame comprising two opposed fixed end platens separated by two connecting rods, a moving platen being mounted on said connecting rods. The moving platen and the opposed fixed platen have die halves mounted thereon for closing and clamping prior to casting. The patent also discloses a novel and an improved injection system in which said injection system is disposed in dose proximity to the fixed die half so that the injection nozzle may be inserted in the bottom portion of the fixed die half below the cavity.

The injection unit of this invention differs in important respects from the invention disclosed in the earlier patent referred to above. In the invention which is the subject matter of this invention the liquid metal is ladled or otherwise transferred directly into the opening at the top of the injection unit receiver of the injection sleeve. The volume of the liquid metal which must be injected varies from casting to casting. To minimize air entrapment the bottom position of the injection plunger is adjusted so that the volume of the interior of the injection sleeve is substantially topped up with molten metal whether the casting calls for a small volume or larger volume of metal. Other differences include temperature control of the injection plunger and temperature control of the injection sleeve. A still further difference is the projecting shape of the injection plunger head which is so shaped as to reduce the size of the biscuit left cooling in the top of the injection sleeve when the casting is cooled. The injection plunger is retracted as soon as the metal has solidified. The biscuit cooling on the top of the injection sleeve remains attached to the runner and casting and is removed from the part line with the withdrawal of the moving platen and moving die half. The biscuit and runner are subsequently trimmed from the casting during the trimming operation. The fact that the biscuit is limited in size and is removed with the moving die half leaves the top of the injection sleeve free of debris and ready for filling for the next shot.

U.K. Patent Application GB 2 123 326 A discloses an injection unit for a cold chamber die casting machine in which an inclined cylindrical passage is formed in the fixed mould and fixed platen. An injection mould cylinder is inserted in the inclined cylindrical passage through the fixed platen but not through the fixed mould. A drive piston is located in the injection mould cylinder. The injection mould cylinder includes a molten metal inlet located in the injection mould cylinder a substantial distance below the fixed platen. The drive piston is withdrawn below the molten metal inlet and molten metal is supplied to the injection mould cylinder through the molten metal inlet until there is sufficient molten metal in the injection mould cylinder for the next casting. As will be seen in the drawings of GB 2 123 326 A the molten metal poured into the molten metal inlet settles in the injection mould cylinder but not in the cylindrical passage in the fixed mould. In contrast, in the invention of this application, the molten metal is top filled through the fixed die half such that the molten metal is proximate the face of the fixed die half. In the invention of this application the bottom or retracted position of the piston is controlled so that the void in the top of the injection cylinder is substantially equal to the molten metal required for the next casting. The injection cylinder is substantially filled leaving very little space for air at the top of the injection cylinder.

U.S. Pat. No. 4,006,774 to Mikulski discloses a Die Casting Apparatus Which Eliminates Shot Sleeve Metal Contact. The patent discloses vertical shot sleeves or inclined shot sleeves in which the shot sleeves extend through both the fixed platen and the fixed die to the part plane. The shot sleeves serve as a cylinder for a reciprocating piston which delivers the molten metal to the narrow runner and die cavity. The reciprocating plunger features an upper face cavity which is adapted to receive sufficient molten metal to fill the runners and the die cavity. Molten metal is poured into the upper face cavity of the reciprocating piston through a pour hole in the shot sleeve positioned a substantial distance below the fixed platen and fixed die. The invention of U.S. Pat. No. 4,006,774 does not disclose top filling of the injection sleeve at the part line such that the molten metal is proximate the runners and the opening in the dies adapted to receive the molten metal. A further difference between the invention of this application and that of U.S. Pat. No. 4,006,774 lies in the fact that in the instant application larger or smaller volumes of molten metal may be retained proximate the top of the injection sleeve by controlling the lower position of the injection piston. U.S. Pat. No. 4,006,774 would require piston heads with substantial cavities to receive the molten metal required for large castings. The instant invention does not require air vents running through the fixed platen and fixed die halves to vent air above the pour vent when the plunger is advanced upwardly in the injection sleeve.

One embodiment of the invention is an injection unit for a cold chamber die casting machine having a part line on which the die halves meet, the injection unit being comprised of an open upwardly inclined injection sleeve, an injection plunger, means to advance and retract the injection plunger and means to control the extent of retraction of the injection plunger, the top of the injection sleeve being disposed at or proximate the part line.

Another embodiment of the invention is an injection unit for a cold chamber die casting machine having a part line on which the die halves meet, the injection unit being comprised of an open upwardly inclined injection sleeve, an injection plunger, means to advance and retract the injection plunger and means to control the extent of retraction of the injection plunger, the top of the open upwardly inclined injection sleeve being disposed at the part line, the bottom of the stroke of the injection plunger is within the injection sleeve and is adjusted to enable the injection sleeve to be substantially filled to the top with molten metal when the die halves are open.

A further embodiment of the invention is an injection unit for a cold process die casting machine having a part line on which the die halves meet, the injection unit being comprised of an open upwardly inclined injection sleeve, an injection plunger, means to advance and retract the injection plunger and means to control the extent of retraction of the injection plunger, the injection sleeve is open and upwardly disposed, an injection unit receiver mounted below the fixed die half adapted to receive the upwardly inclined injection sleeve of the injection unit.

Another embodiment of the invention is an injection unit for a cold chamber die casting machine having a fixed die half with an upwardly inclined aperture defining an opening therein and a moving die half, the upwardly inclined aperture in the fixed die half is adapted to receive the upwardly inclined injection sleeve of the injection unit in the opening therein.

In still a further embodiment of the invention there is provided an injection chamber for a cold process die casting machine having a part line on which the die halves meet, the injection unit comprised of an open upwardly inclined injection sleeve, an injection plunger and means to advance and retract the injection plunger, an injection unit receiver mounted below the fixed die half on the part line adapted to receive the upwardly inclined injection sleeve of the injection unit, in which the moving die half closes on the fixed die half and the injection unit receiver prior to the advance of the injection plunger of the injection unit.

The invention also relates to a method of injecting molten metal in a cold chamber die casting machine having a moving die half and a fixed die half, the fixed die half is fastened to a fixed platen, the fixed die half and moving die half meeting on the part line, an injection sleeve having a retractable plunger therein disposed at a vertical or inclined angle at or proximate the part line, the retractable plunger being adapted to receive or dispel molten metal therefrom, the method comprising the steps of (a) setting the retracted position of the injection plunger in the injection sleeve (b) opening the moving die half sufficiently to fill the injection sleeve at the part line substantially to the top with molten metal, (c) closing the moving die half on the fixed die half and top of the injection sleeve, (d) moving the injection plunger upwardly in the injection sleeve until the injection plunger is proximate the part line.

IN THE DRAWINGS

Figure 1:
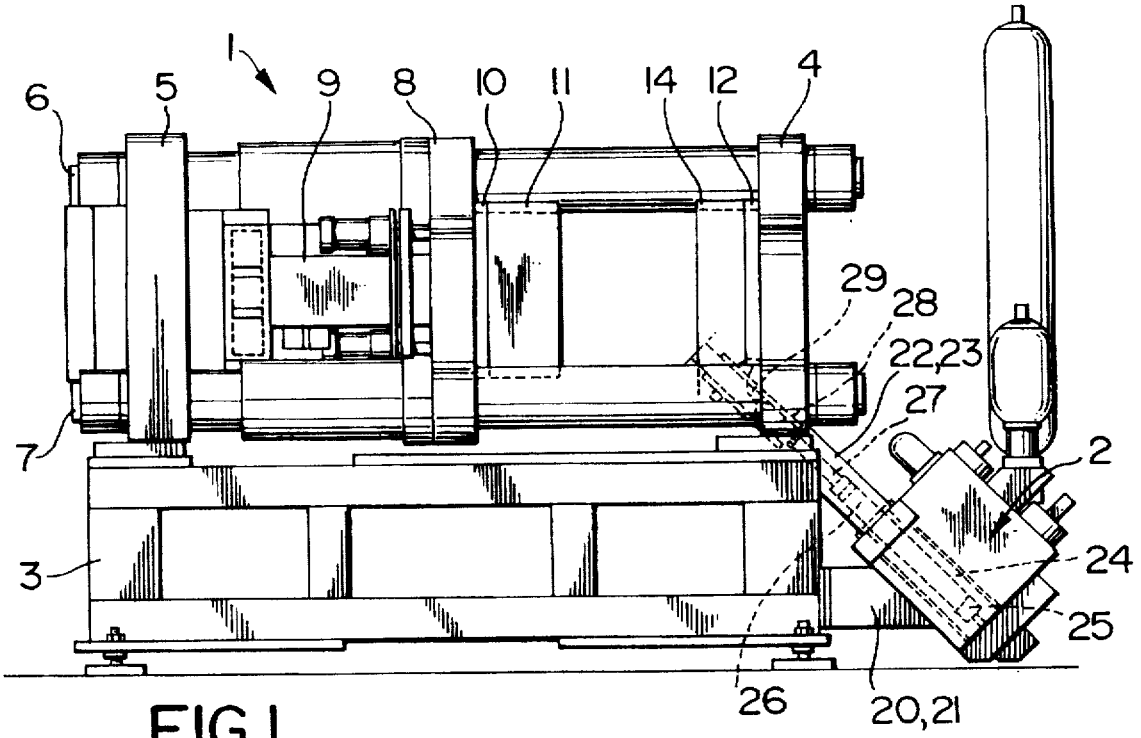
FIG. 1 is a side elevation view of a cold chamber die casting machine with an injection unit connected to the end of the machine to which the fixed platen and fixed die half are connected.

Referring to FIG. 1, there is shown a cold chamber die casting machine 1 with an injection unit 2 mounted on the right hand end of the cold chamber die casting machine 1. The cold chamber die casting machine 1 is comprised of a die casting machine base 3. A fixed platen 4 is located towards the right hand end of die casting machine base 3 and a fixed platen 5 is located towards the left hand end of die casting machine base 3. The fixed platens 4, 5 have rods 6,7 mounted therethrough. A moving platen 8 is mounted on rods 6, 7 for movement towards the fixed platen 4 or withdrawal from fixed platen 4. The moving platen 8 is moved towards fixed platen 5 or withdrawn from fixed platen 5 by hydraulics, toggles or other mechanical means known in the art represented by number 9. Cooling base 10 and moving die half 11 are mounted on moving platen 8. Fixed platen cooling base 12 and fixed die half 14 are mounted on fixed platen 4.

Figure 2:
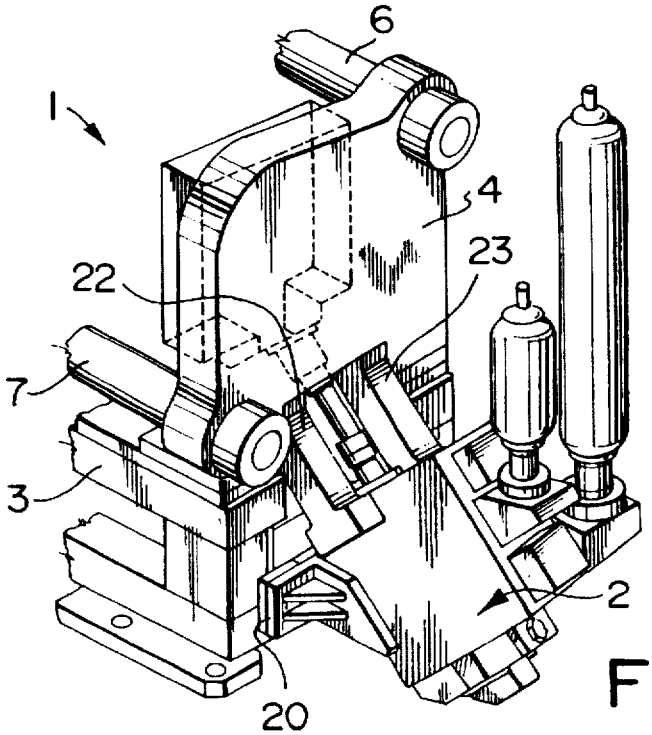
FIG. 2 is a perspective view of the injection unit connected to the machine base at one end of the cold chamber die casting machine.

As seen in FIGS. 1 and 2 injection unit 2 is mounted by front and rear brackets 20, 21 and injection unit support arms 22, 23 to the right hand end of die casting machine base 3 and fixed 4 respectively.

The injection unit 2 is comprised of an injection cylinder 24 having a piston 25 mounted near the base of the hydraulic cylinder 24 for movement of the injection plunger 28 towards and away from the fixed platen 4, cooling base 12 and fixed die 14. A piston rod 26 is connected at one end to the piston 25 and at the other end to the piston rod-injection plunger connecting link 27. The piston rod-injection plunger connecting link 27 is connected at its upper end to injection plunger 28.

Figure 4:
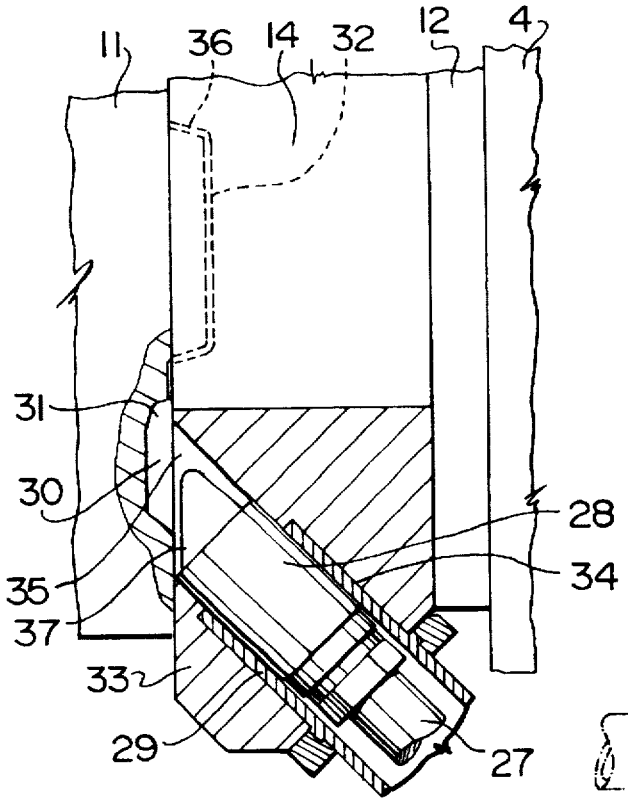
FIG. 4 is a cross-sectional view along the longitudinal centerline of the top of injection unit showing the relationship of the injection unit to the closed moving and fixed die halves during the injection step.

As seen in FIG. 1, the moving die half 11 is mounted on cooling base 10 which in turn is mounted on moving platen 8. As seen in FIG. 4, the face of moving die half 11 closes on the part line immediately prior to injection, and remains on the part line during injection and until the injected metal solidifies sufficiently to withdraw the moving platen 8, cooling base 10 and moving die half 11 away from the fixed die half 14 mounted on fixed platen cooling base 12. The face of moving die half 11 attached to cooling base 10 attached to the moving platen 8 includes a runner 30 through which the molten metal 31 travels to the cavity 32 between moving die half 11 and fixed die half 14.

Figure 5:
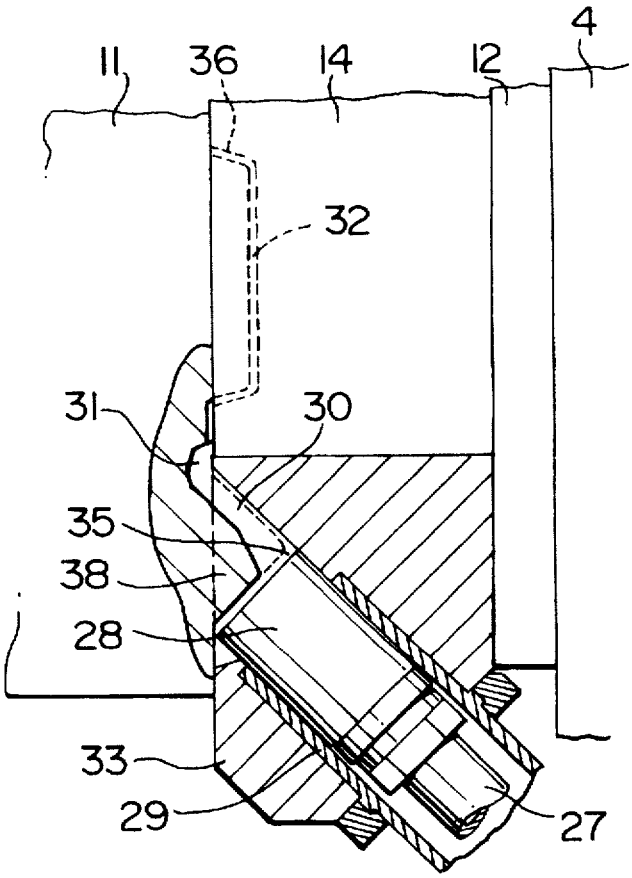
FIG. 5 is a cross-sectional view along the longitudinal centerline of the injection unit showing a protruding cooled nose extending from the face of the moving die half in close proximity to an injection plunger with a flat face.
Figure 6:
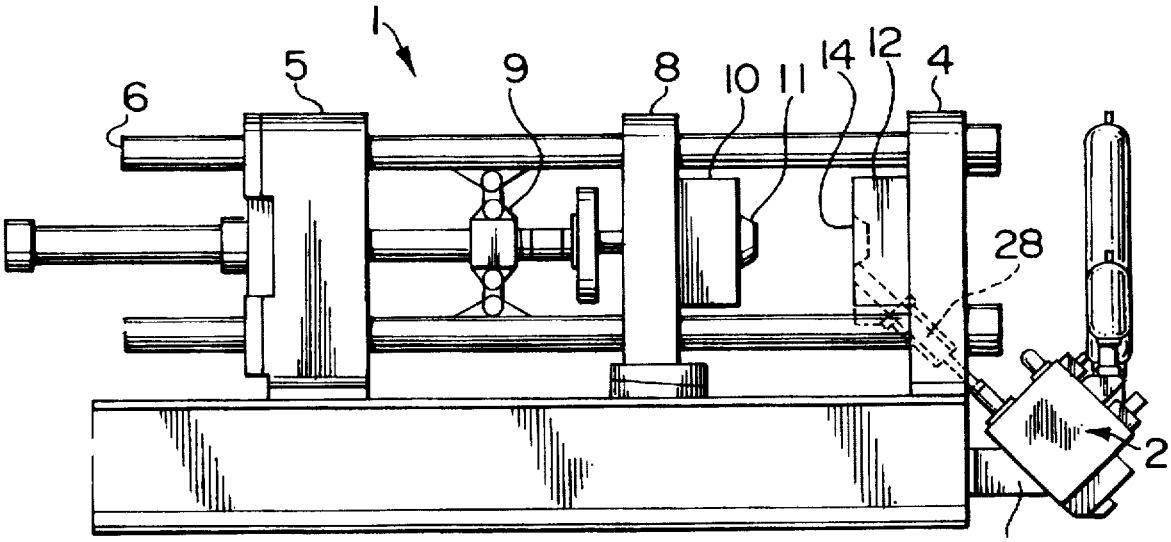
FIG. 6 is a perspective view of the injection unit connected to the machine base of a 4-tie bar cold chamber die casting machine with toggles.

FIG. 5 discloses an injection plunger 28 having a flat face as opposed to the nose 37 of the injection plunger 28 shown in FIG. 4. The moving die half 11 has a protruding cooled nose 38 which extends across the part line between the moving die half 11 and fixed die half 14 when the die halves are closed. When the die halves are opened after the casting has solidified, the casting, runner and biscuit 35 are withdrawn with the moving die half 11 which is connected to the moving platen 8.

Referring to FIG. 4, an injection unit receiver 33 is mounted below the fixed die half 14. In the event of corrosion or damage to the injection unit receiver 33 the injection unit receiver 33 may be replaced without replacing the fixed die half 14. The injection unit receiver 33 has a cylindrical passage defining an opening 34 adapted to receive injection sleeve 29.

Figure 7:
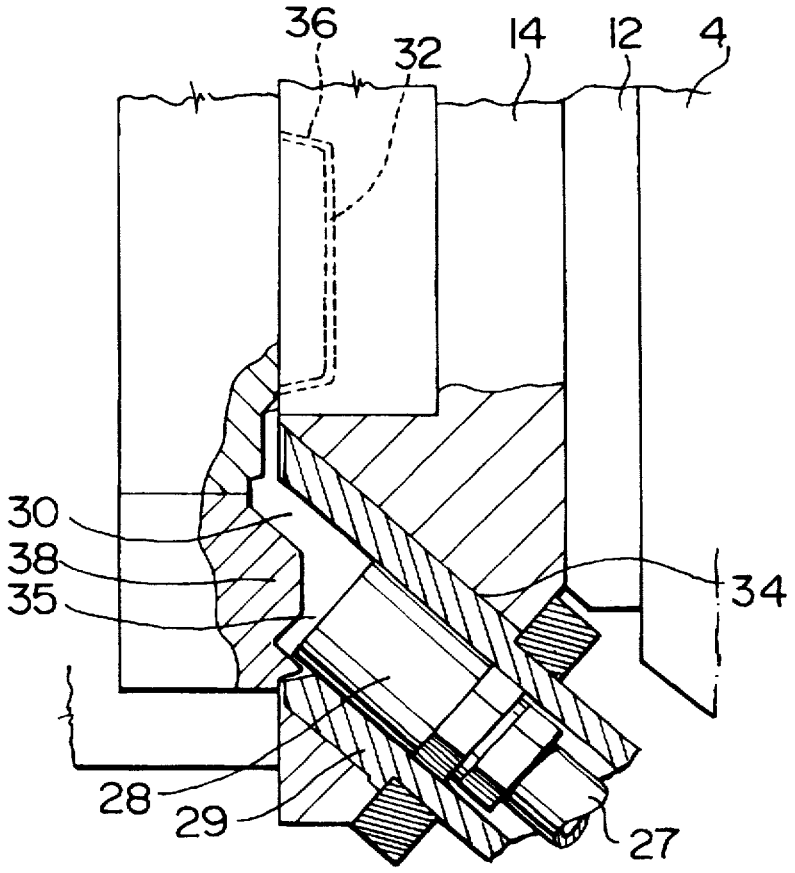
FIG. 7 is a cross-sectional view through a cold chamber die casting machine in which the injection unit is disposed in a bevel sleeve in an aperture in the base of the fixed die half.

Referring to FIG. 7, a fixed die half 14 is disclosed which has a cylindrical passage defining an opening 34 adapted to receive injection sleeve 29. In FIG. 7 the injection sleeve 29 is inserted directly into the opening 34 in the fixed die half 14 as opposed to being inserted in an injection unit receiver 33 as shown in FIG. 4. As shown in FIG. 7 the injection sleeve 29 extends upwardly substantially to the part line.

Referring to FIG. 4 the piston 25, piston rod 26 and piston rod injection plunger connecting link 27 may be withdrawn from the injection sleeve 29, if the piston 25, piston rod 26 and piston rod-injection plunger connecting link 27 require adjustment or repair. The injection sleeve 29 is inserted and retained in the opening 34 in injection unit receiver 33. The range of movement of piston 25 in injection cylinder 24 is adjusted with each die so as to reduce air at the top of the injection sleeve 29 to a minimum during filling of the injection sleeve 29 with molten metal and secondly to limit the size of the biscuit 35 remaining above the injection plunger 28 when the casting 36 cools.

Figure 3:
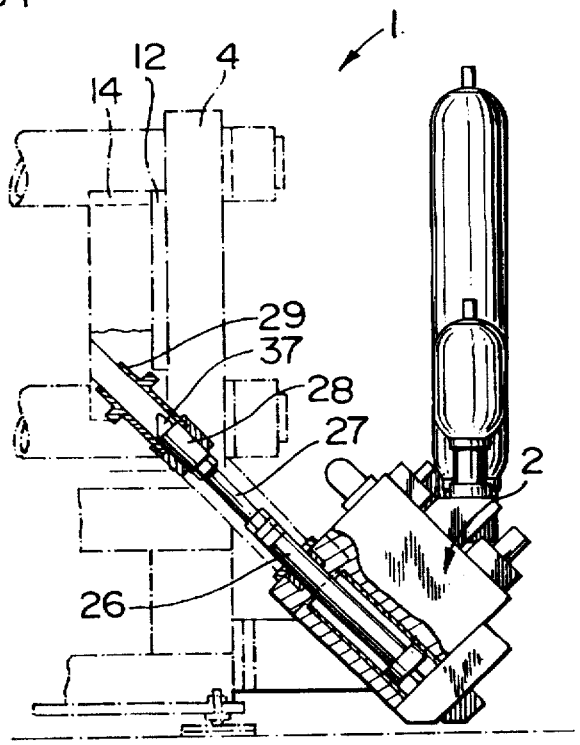
FIG. 3 is a cross-sectional view along the longitudinal centerline of the injection unit showing the injection plunger in open position adapted to receive hot liquid metal.

While the injection unit 2 is shown in FIGS. 1 to 3 mounted on the right hand end of the cold chamber die casting machine 1 in such a manner that the injection unit 2 extends upwardly at forty-five degrees relative to the right hand end of the cold chamber die casting machine 1, it will be appreciated by those skilled in the art that the angle of the injection unit 2 relative to the die halves may extend from vertical, where the injection power unit 2 would be located under the part line on which the moving die half 11 and the fixed die half 14 meet anywhere up to approximately 20° relative to horizontal.

As seen in FIGS. 1 and 3 the moving platen 8 is withdrawn from the fixed platen 4. The top of the injection sleeve 29 is open at the part line and adapted to receive molten metal. The injection plunger 28 has been withdrawn within the injection sleeve to a position such that when the injection sleeve 29 is filled with molten metal the injection sleeve 29 will be substantially topped up with metal decreasing air entrapment during the injection cycle. When the injection sleeve 29 is filled, the moving platen 8 is moved towards the part line until the moving die half 11 closes on the fixed die half 14 as shown in FIG. 4. Following the closing of the moving die half 11 and fixed die half 14 the die halves are clamped shut prior to injection of the molten liquid. After clamping the injection plunger 28 is advanced towards the part line driving the molten liquid in the injection sleeve 29 into the runner 30 and cavity 32 between the moving die half 11 and the fixed die half 14. When the molten liquid has solidified into a casting, the moving platen 8 is withdrawn from the part line. The casting, runner and biscuit 35 are withdrawn with the moving die half 11 which is connected to the moving platen 8. The casting, runner and biscuit 35 are subsequently removed from the moving die half 11 and runner 30 by ejection pins prior to commencement of the next cycle. The injection plunger 28 is withdrawn within injection sleeve 29 prior to the addition of molten metal to the injection sleeve 29 as part of the next cycle.

While the injection power unit has been described herein with respect to a cold chamber die casting machine 1 having a fixed platen and a moving platen, it will be recognized by those skilled in the art that the power injection unit of this invention may be adapted for use with any cold chamber die casting machines which have been suitably adapted without departing from the scope of the invention.

We claim:

1. A method of injecting molten metal into a cold chamber die casting machine using an injection unit, the top filling injection unit consisting of an open upwardly inclined injection sleeve, an injection plunger, an injection plunger-piston rod connecting link, a piston rod, a piston and a hydraulic cylinder, the injection plunger being connected by the injection plunger-piston rod connecting link to the piston rod, the piston rod is connected to the piston located in the hydraulic cylinder, the injection plunger located within the upwardly inclined injection sleeve having an upper injecting position and a retracted filling position within the open upwardly inclined injection sleeve, the upwardly incline injection position being proximate the top of the upwardly inclined injection sleeve, the lower retracted filling position of the injection plunger located within the upwardly inclined injection sleeve being adjustable to any desired retracted filling position within the upwardly inclined injection sleeve, characterized by selecting a lower retracted filling position of the injection plunger in the upwardly inclined injection sleeve, filling the space in the inclined injection sleeve above the injection plunger with molten metal substantially completely, and moving the injection plunger upwardly in the injection sleeve to the injection position proximate the top of the injection sleeve forcing the molten metal into the cold chamber die casting machine.

2. A top filling injection unit for a cold chamber die casting machine, the top filling injection unit consisting of an open upwardly inclined injection sleeve, and injection plunger, and injection plunger-piston rod connecting link, a piston rod, a piston and a hydraulic cylinder, the injection plunger being connected by the injection plunger-piston rod connecting link to the piston rod, the piston rod is connected to the piston located in the hydraulic cylinder, characterized by the injection plunger located within the upwardly inclined injection sleeve having an upper injecting position and a lower retracted filing position within the open upwardly inclined injection sleeve, the upwardly inclined injection position being proximate the top of the upwardly inclined injection sleeve, the lower retracted filling position of the injection plunger located within the upwardly inclined injection sleeve being adjustable to any desired retracted filling position within the upwardly inclined injection sleeve.

3. The top filling injection unit for a cold chamber die casting machine of claim 2, in which the top of the injection plunger has an upwardly and outwardly extending surface.

4. A cold chamber die casting machine having a top filling injection unit, a fixed platen, a moving platen, a fixed die half, a moving die half, and a part line on which the moving die half and the fixed die half meet, the fixed die half is mounted on the fixed platen and the moving die half is mounted on the moving platen, the top filling injection unit consisting of an open upwardly inclined injection sleeve, an injection plunger, and injection plunger-piston rod connecting link, a piston rod, a piston and a hydraulic cylinder, the injection plunger located in the injection sleeve being connected by injection plunger-piston rod connecting link to the piston rod, the piston rod is connected to the piston located in the hydraulic cylinder, an aperture defining an upward opening in the fixed die half, the injection sleeve located in the aperture defining the upward opening in the fixed platen, the injection plunger located within the upwardly inclined injection sleeve having an upper injecting position and a lower retracted filling position within the open upwardly inclined injection sleeve, the upwardly inclined injection position being proximate the top of the upwardly inclined injection sleeve, the lower retracted filing position of the injection plunger located within the upwardly inclined injection sleeve being adjustable to any desired retracted filling position within the upwardly inclined injection sleeve.

5. The cold chamber die casting machine of claim 4 having a fixed die half and an injection unit receiver, the injection unit receiver fastened to the base of the fixed die half, an aperture defining an upwardly inclined passage in the injection unit receiver, the injection sleeve disposed in the aperture defining the upwardly inclined passage in the injection unit receiver.

6. The cold chamber die casting machine of claim 4 in which the injection sleeve is disposed between a vertical position and a position 45° from vertical.

7. The cold chamber die casting machine of claim 4 in which the nose of the injection plunger inclines forwardly and upwardly.

8. The cold chamber die casting machine of claim 6 in which the moving die half has a protruding nose which extends over the part line when the die halves are clamped.

* * * * *